US010061255B2

(12) United States Patent
Dobashi

(10) Patent No.: US 10,061,255 B2
(45) Date of Patent: Aug. 28, 2018

(54) SHEET PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Shoichi Dobashi, Sunto Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/796,348

(22) Filed: Oct. 27, 2017

(65) Prior Publication Data

US 2018/0067440 A1 Mar. 8, 2018

Related U.S. Application Data

(63) Continuation of application No. 15/207,142, filed on Jul. 11, 2016, now Pat. No. 9,851,677.

(30) Foreign Application Priority Data

Sep. 14, 2015 (JP) ..... 2015-181108

(51) Int. Cl.
*B65H 31/30* (2006.01)
*B65H 29/34* (2006.01)
(Continued)

(52) U.S. Cl.
CPC ..... *G03G 15/6541* (2013.01); *B65H 29/125* (2013.01); *B65H 29/14* (2013.01); *B65H 29/34* (2013.01); *B65H 29/58* (2013.01); *B65H 31/02* (2013.01); *B65H 31/24* (2013.01); *B65H 31/3018* (2013.01); *B65H 31/3027* (2013.01); *B65H 31/3081* (2013.01);
(Continued)

(58) Field of Classification Search
CPC ..... B65H 31/3018; B65H 31/3081; B65H 31/3009; B65H 31/32; B65H 31/30; B65H 29/34
See application file for complete search history.

(56) References Cited

U.S. PATENT DOCUMENTS 5,344,130 A 9/1994 Suzuki et al.
6,120,020 A 9/2000 Asao
(Continued)

FOREIGN PATENT DOCUMENTS

JP 05147186 A * 6/1993
JP 2000169025 A 6/2000
(Continued)

OTHER PUBLICATIONS

Chinese Office Action dated Jul. 25, 2017, filed in Chinese counterpart Application No. 201610730756.0, 11 pages (with translation).

*Primary Examiner* — Luis A Gonzalez
(74) *Attorney, Agent, or Firm* — Patterson & Sheridan, LLP

(57) ABSTRACT

According to an embodiment, a sheet processing apparatus includes a first tray, a second tray, a discharge member, and a guide. The guide is provided to the second tray and changes a transport angle of sheets with respect to the second tray when the sheets are sent from a transport path toward the discharge member without passing through the first tray.

16 Claims, 11 Drawing Sheets

(51) Int. Cl.

| | |
|---|---|
| ***G03G 15/00*** | (2006.01) |
| ***B65H 31/36*** | (2006.01) |
| ***B65H 31/02*** | (2006.01) |
| ***B65H 29/14*** | (2006.01) |
| ***B65H 29/12*** | (2006.01) |
| ***B65H 31/24*** | (2006.01) |
| ***B65H 29/58*** | (2006.01) |
| ***B65H 31/38*** | (2006.01) |

(52) U.S. Cl.

CPC ..... *B65H 31/36* (2013.01); *B65H 31/38* (2013.01); *G03G 15/6538* (2013.01); *G03G 15/6544* (2013.01); *B65H 2220/08* (2013.01); *B65H 2220/11* (2013.01); *B65H 2301/163* (2013.01); *B65H 2301/4212* (2013.01); *B65H 2301/4213* (2013.01); *B65H 2403/942* (2013.01); *B65H 2404/692* (2013.01); *B65H 2404/693* (2013.01); *B65H 2405/1116* (2013.01); *B65H 2405/332* (2013.01); *B65H 2405/3311* (2013.01); *B65H 2511/214* (2013.01); *B65H 2801/27* (2013.01); *G03G 2215/00286* (2013.01)

(56) References Cited

U.S. PATENT DOCUMENTS

| | | | |
|---|---|---|---|
| 6,305,681 | B1 | 10/2001 | Watanabe et al. |
| 7,172,186 | B2 | 2/2007 | Saito et al. |
| 7,258,339 | B2 | 8/2007 | Fukatsu et al. |
| 7,731,169 | B2 | 6/2010 | Saito |
| 7,832,725 | B2 | 11/2010 | Hosoya et al. |
| 7,862,024 | B2 | 1/2011 | Taguchi et al. |
| 7,984,900 | B2 | 7/2011 | Terao et al. |
| 2007/0057435 | A1 | 3/2007 | Terao et al. |
| 2010/0196073 | A1 | 8/2010 | Taki |

FOREIGN PATENT DOCUMENTS

| | | | |
|---|---|---|---|
| JP | 2002114431 | A | 4/2002 |
| JP | 2013134351 | A | 7/2013 |

* cited by examiner

SHEET PROCESSING APPARATUS

CROSS-REFERENCE TO RELATED APPLICATIONS

This application is a continuation of U.S. patent application Ser. No. 15/207,142, filed on Jul. 11, 2016, which is based upon and claims the benefit of priority from the prior Japanese Patent Application No. 2015-181108, filed on Sep. 14, 2015, the entire contents of each of which are incorporated herein by reference.

FIELD

An embodiment described here generally relates to a sheet processing apparatus.

BACKGROUND

A sheet processing apparatus that performs post-processing such as sorting processing or stapling processing on sheets transported from an image-forming apparatus is known. In a non-sorting mode in which the sorting processing and the stapling processing are not performed, the sheet processing apparatus directly discharges the sheets transported from the image-forming apparatus to a discharge tray of the sheet processing apparatus. In such a sheet processing apparatus, improvement in stability of sheet transport is demanded.

DETAILED DESCRIPTION

According to an embodiment, a sheet processing apparatus includes a first tray, a second tray, a discharge member, and a guide. The first tray supports sheets transported from a transport path. The second tray is provided below the first tray and supports the sheets moved from the first tray. The discharge member is provided to the second tray and discharges the sheets from the second tray. The guide is provided to the second tray and changes a transport angle of the sheets with respect to the second tray when the sheets are transported from the transport path toward the discharge member without passing through the first tray.

Hereinafter, an embodiment will be described with reference to the drawings. It should be noted that in the following description, configurations having an identical or similar function are denoted by an identical reference symbol, and overlapping description thereof may be omitted.

Figure 1:
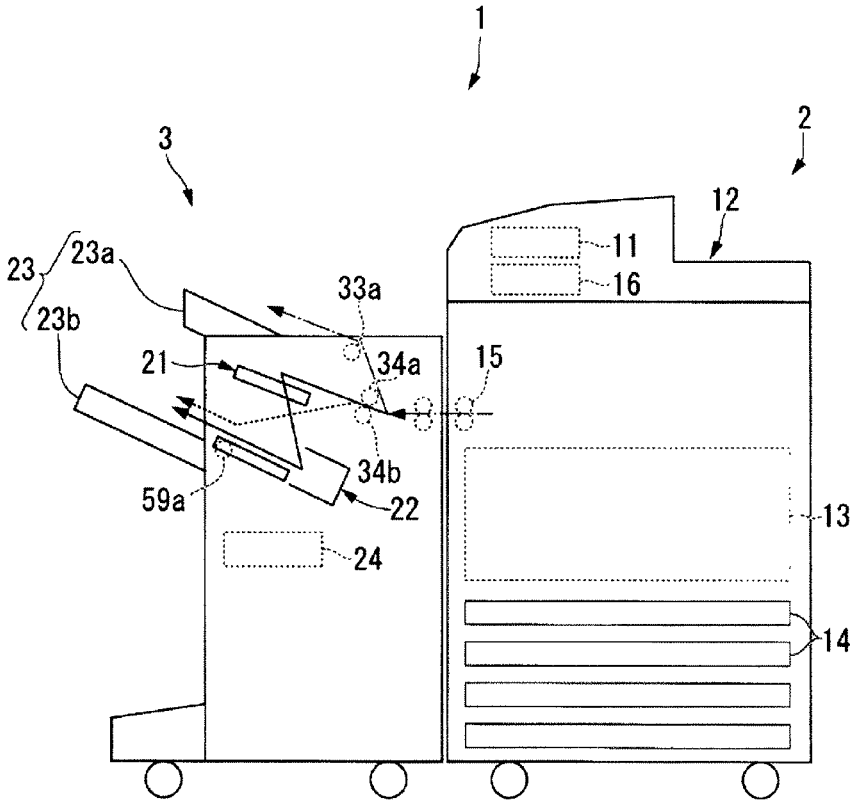
FIG. 1 is a front view showing a configuration example of an image-forming system according to an embodiment.
Figure 2:
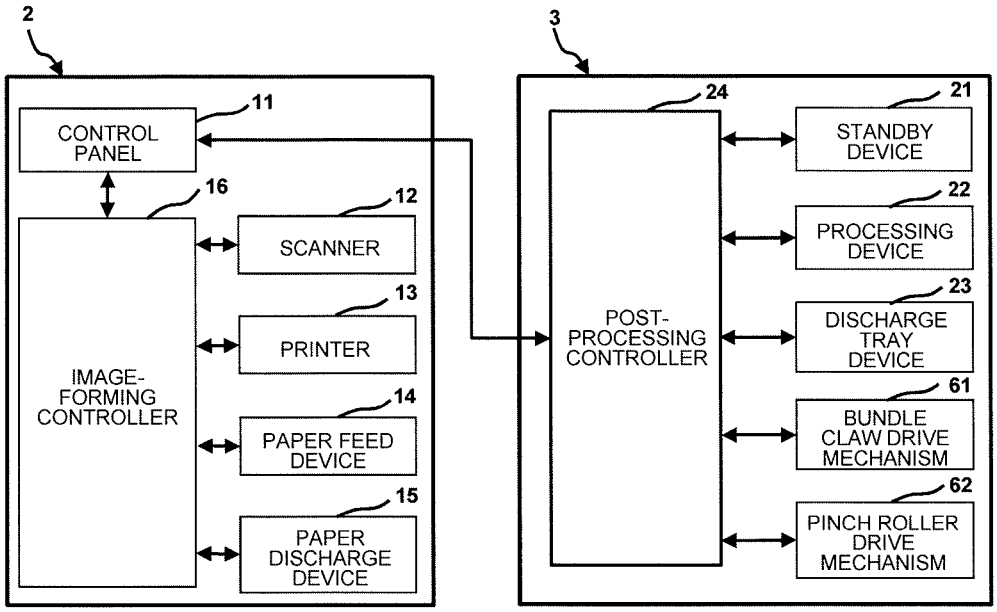
FIG. 2 is a block diagram showing a configuration example of the image-forming system according to the embodiment.

A sheet processing apparatus according to one embodiment will be described with reference to FIGS. 1 to 9. First, FIGS. 1 and 2 each show an example of an overall configuration of an image-forming system 1. As shown in FIGS. 1 and 2, the image-forming system 1 includes an image-forming apparatus 2 and a post-processing apparatus 3.

The image-forming apparatus 2 forms an image on sheet-like media such as paper (hereinafter, described as "sheets"). Specifically, the image-forming apparatus 2 includes a control panel 11, a scanner 12, a printer 13, a paper feed device 14, a paper discharge device 15, and an image-forming controller 16.

The control panel 11 includes various keys that receive user's operations. The control panel 11 receives an input on a type of post-processing performed on sheets. For example, the control panel 11 receives a selection of a sorting mode in which sorting processing is performed, a stapling mode in which stapling processing is performed, or a non-sorting mode in which the sorting processing and the stapling processing are not performed. Additionally, when the non-sorting mode is selected, the control panel 11 receives a selection on whether sheets are discharged to a fixed tray 23*a* or a movable tray 23*b* of the post-processing apparatus 3, which will be described later. The image-forming apparatus 2 transmits information on the mode selected by the control panel 11 and on a discharge destination of the sheets to the post-processing apparatus 3.

The scanner 12 includes a read section that reads image information of an object to be duplicated. The scanner 12 transmits the read image information to the printer 13. The printer 13 forms an output image (hereinafter, described as "toner image") by a developer such as toner on the basis of the image information transmitted from the scanner 12 or an external device. The printer 13 forms the toner image on a photoreceptor, which is an image carrier, for example, and transfers the toner image onto a sheet at a transfer position. The printer 13 applies heat and pressure to the toner image transferred onto the sheet, to fix the toner image onto the sheet.

The paper feed device 14 supplies sheets to the transfer position one by one at a timing at which the printer 13 forms the toner image. The paper discharge device 15 transports the sheets, which are discharged from the printer 13, to the post-processing apparatus 3.

The image-forming controller 16 controls an overall operation of the image-forming apparatus 2. In other words, the image-forming controller 16 controls the control panel 11, the scanner 12, the printer 13, the paper feed device 14, and the paper discharge device 15. For example, the image-forming controller 16 is a control circuit including a CPU (Central Processing Unit), a ROM (Read Only Memory), and a RAM (Random Access Memory).

Next, the post-processing apparatus 3 will be described. The post-processing apparatus 3 is an example of a "sheet processing apparatus". As shown in FIG. 1, the post-processing apparatus 3 is disposed adjacently to the image-forming apparatus 2. The post-processing apparatus 3 executes processing on sheets transported from the image-forming apparatus 2, the processing corresponding to a mode selected through the control panel 11. Specifically, the post-processing apparatus 3 includes a standby device 21, a processing device 22, a discharge tray device 23, and a post-processing controller 24.

The standby device 21 temporarily retains (buffers) sheets S (see FIG. 3) transported from the image-forming apparatus 2, which is an external apparatus. For example, the standby device 21 keeps subsequent sheets S waiting during post-processing performed on preceding sheets S in the processing device 22. When the processing device 22 becomes empty, the standby device 21 drops the retained sheets S toward the processing device 22.

The processing device 22 performs predetermined post-processing on the sheets S. The post-processing is sorting processing, stapling processing, or the like. For example, the processing device 22 aligns the sheets S. The processing device 22 performs the stapling processing on the aligned sheets S. As a result, the sheets S are bound together. The processing device 22 discharges the sheets S, which have been subjected to the post-processing, to the discharge tray device 23.

The discharge tray device 23 includes the fixed tray (fixed discharge tray) 23*a* and the movable tray (movable discharge tray) 23*b*. The fixed tray 23*a* is provided to an upper portion of the post-processing apparatus 3. Meanwhile, the movable tray 23*b* is provided to a side portion of the post-processing apparatus 3. The movable tray 23*b* is movable vertically along the side portion of the post-processing apparatus 3. The sheets S are discharged to the fixed tray 23*a* and the movable tray 23*b* in accordance with a discharge destination of the sheets S, which is selected through the control panel 11. The fixed tray 23*a* and the movable tray 23*b* support the discharged sheets S.

The post-processing controller 24 controls an overall operation of the post-processing apparatus 3. In other words, the post-processing controller 24 controls the standby device 21, the processing device 22, and the discharge tray device 23. Further, as shown in FIG. 2, the post-processing controller 24 controls operations of a bundle claw drive mechanism 61 and a pinch roller drive mechanism 62, both of which will be described later. For example, the post-processing controller 24 is a control circuit including a CPU, a ROM, and a RAM.

Next, configurations of respective sections of the post-processing apparatus 3 will be described in detail.

It should be noted that in the following description, an "upstream side" and a "downstream side" mean an "upstream side" and a "downstream side" in a sheet transport direction D, respectively.

Figure 3:
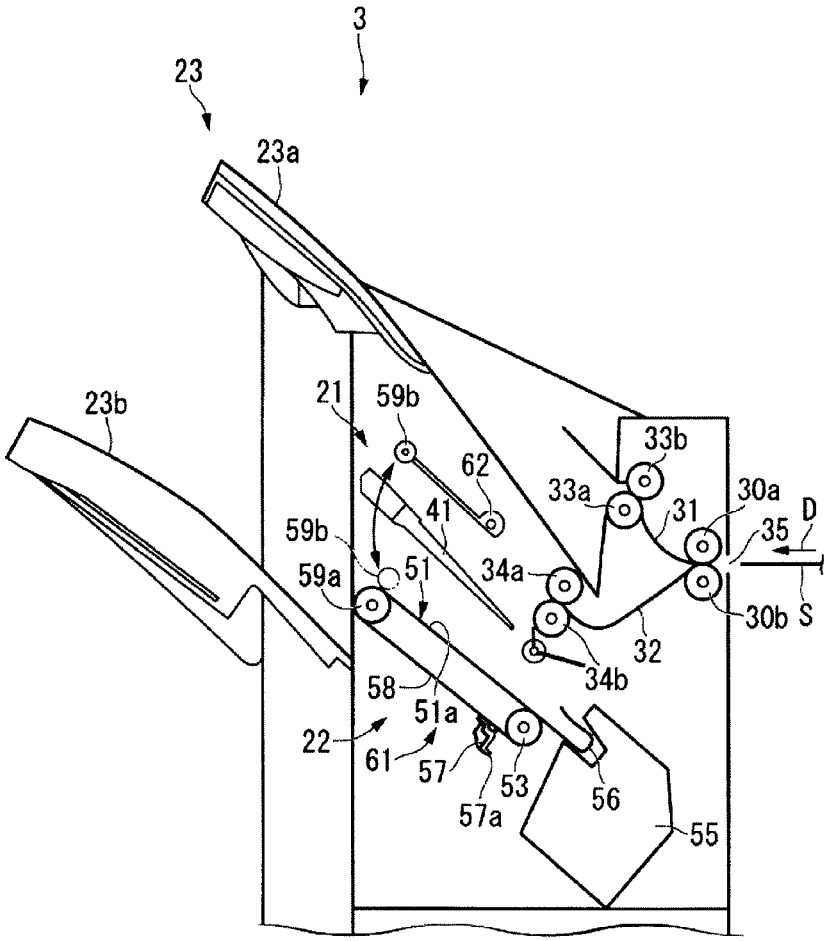
FIG. 3 is a cross-sectional view showing a post-processing apparatus according to the embodiment.

FIG. 3 is a cross-sectional view showing the post-processing apparatus 3 of this embodiment. As shown in FIG. 3, the post-processing apparatus 3 includes inlet rollers 30*a* and 30*b*, transport paths 31 and 32 for the sheets S, discharge rollers 33*a* and 33*b*, outlet rollers 34*a* and 34*b*, the standby device 21, and the processing device 22.

The inlet rollers 30*a* and 30*b* are provided near a sheet supply port 35 of the post-processing apparatus 3. The sheets S are supplied from the image-forming apparatus 2 to the sheet supply port 35. The inlet rollers 30*a* and 30*b* transport the sheets S, which have been supplied to the sheet supply port 35, toward the inside of the post-processing apparatus 3.

The transport paths 31 and 32 include a first transport path 31 and a second transport path 32. The first transport path 31 is provided between the inlet rollers 30*a* and 30*b* and the fixed tray 23*a* of the discharge tray device 23. In the non-sorting mode, when the fixed tray 23*a* is selected as a discharge destination of the sheets S, the first transport path 31 guides the sheets S, which are supplied to the sheet supply port 35, toward the fixed tray 23*a*. The discharge rollers 33*a* and 33*b* are provided to the end of the first transport path 31 on the downstream side. The discharge rollers 33*a* and 33*b* discharge the sheets S, which have been transported to the first transport path 31, toward the fixed tray 23*a*.

Meanwhile, the second transport path 32 is provided between the inlet rollers 30*a* and 30*b* and the outlet rollers 34*a* and 34*b* inside the post-processing apparatus 3. When the sorting mode or the stapling mode is selected, the second transport path 32 guides the sheets S, which are supplied to the sheet supply port 35, toward the outlet rollers 34*a* and 34*b*. The outlet rollers 34*a* and 34*b* are provided to the end of the second transport path 32 on the downstream side. For example, the outlet rollers 34*a* and 34*b* transport the sheets S, which are transported through the second transport path 32, toward the standby device 21. Further, in the non-sorting mode, when the movable tray 23*b* is selected as a discharge destination of the sheets S, the second transport path 32 guides the sheets S, which are supplied to the sheet supply port 35, toward the outlet rollers 34*a* and 34*b*. In this case, as will be described later in detail, the outlet rollers 34*a* and 34*b* send the sheets S, which are transported through the second transport path 32, toward discharge rollers 59*a* of the processing device 22.

Figure 4:
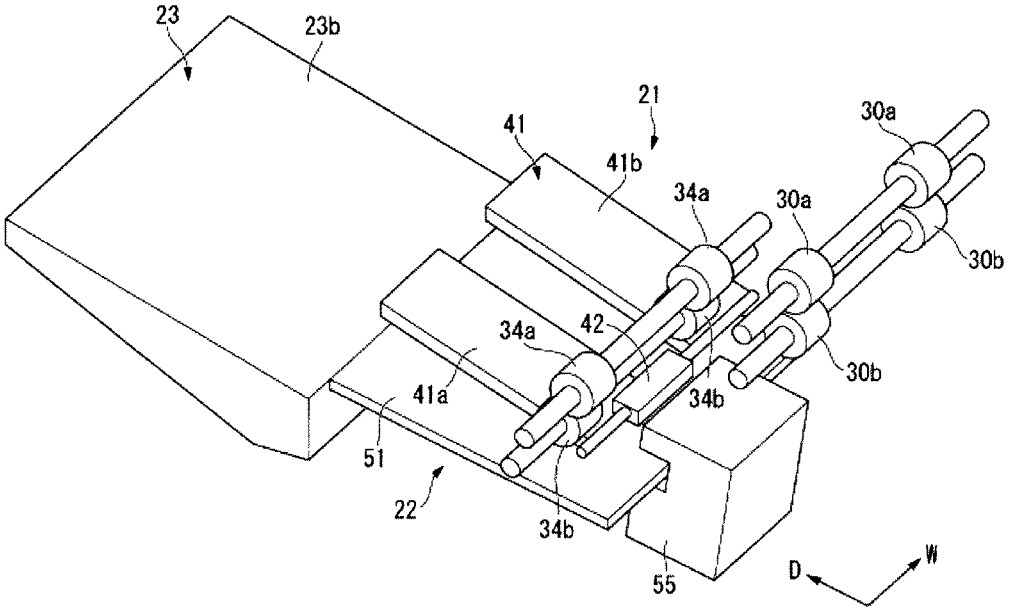
FIG. 4 is a perspective view showing a standby device of the post-processing apparatus according to the embodiment.

The standby device 21 includes a standby tray (buffer tray) 41 and an opening and closing drive mechanism 42 (see FIG. 4). The standby tray 41 is an example of a "first tray". The end of the standby tray 41 on the upstream side is located near the outlet rollers 34*a* and 34*b*. For example, the end of the standby tray 41 on the upstream side is located to be slightly lower than the outlet of the second transport path 32. The standby tray 41 is tilted with respect to a horizontal direction so as to gradually increase in height toward the downstream side of the sheet transport direction D. The sheets S are sent from the second transport path 32 to the standby tray 41. During post-processing performed by the processing unit 22, the standby tray 41 supports the sheets S in order to keep the sheets S waiting in an overlapping manner.

FIG. 4 is a perspective view schematically showing the standby device 21. As shown in FIG. 4, the standby tray 41 includes a first tray member 41*a* and a second tray member 41*b*. The first tray member 41*a* and the second tray member 41*b* are separated from each other in a sheet width direction W. It should be noted that the sheet width direction W is a direction substantially orthogonal to the sheet transport direction D. In the sheet width direction W, the first tray member 41*a* and the second tray member 41*b* are movable in a mutually approaching direction and a mutually separating direction.

When the sheets S are kept waiting in the standby tray 41, the opening and closing drive mechanism 42 moves the first tray member 41*a* and the second tray member 41*b* to a closed position at which the first tray member 41*a* and the second tray member 41*b* are close to each other. As a result, the first tray member 41*a* and the second tray member 41*b* support the sheets S. Meanwhile, when the sheets S are moved from the standby tray 41 toward a processing tray 51 of the processing device 22, the opening and closing drive mechanism 42 moves the first tray member 41*a* and the second tray member 41*b* to an opened position at which the first tray member 41*a* and the second tray member 41*b* are separated from each other. As a result, the sheets S supported by the standby tray 41 pass between the first tray member 41*a* and the second tray member 41*b* and are moved to the processing tray 51. In other words, the standby tray 41 is movable between the closed position to support the transported sheets S and the opened position to cause the transported sheets S to pass without supporting the transported sheets S.

Figure 5:
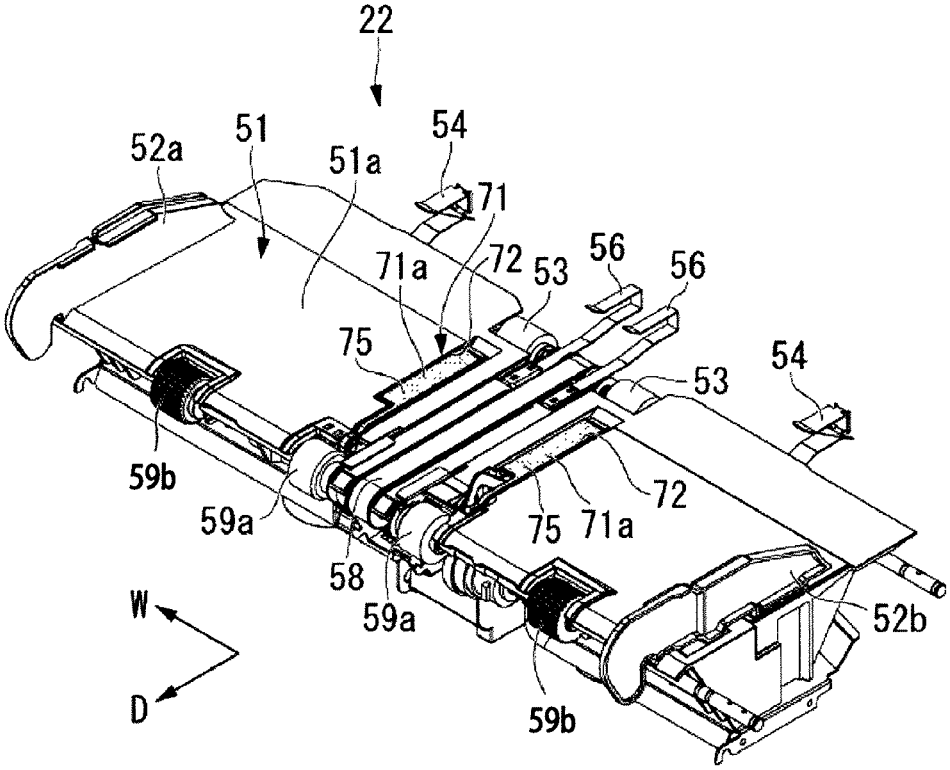
FIG. 5 is a perspective view showing a processing device of the post-processing apparatus according to the embodiment.

Next, the processing device 22 will be described. FIG. 5 is a perspective view showing the processing device 22. As shown in FIG. 5, the processing device 22 includes a processing tray 51, transverse alignment plates 52*a* and 52*b*, longitudinal alignment rollers 53, rear end stoppers 54, a stapler 55 as a processing device (see FIG. 3), ejectors 56, a bundle claw 57 (see FIG. 3), a bundle claw belt 58, and discharge rollers 59*a* and 59*b* (see FIG. 3).

The processing tray 51 is an example of a "second tray". As shown in FIG. 3, the processing tray 51 is provided below the standby tray 41. The processing tray 51 is tilted with respect to a horizontal direction so as to gradually increase in height toward the downstream side of the sheet transport direction D. The processing tray 51 includes a transport surface 51*a*, which supports the sheets S, i.e., on which the sheets S are placed.

As shown in FIG. 5, the transverse alignment plates (transverse alignment mechanism) 52*a* and 52*b* are provided to the transport surface 51*a* of the processing tray 51. The paired transverse alignment plates 52*a* and 52*b* are provided separately from each other in the sheet width direction W. In the sheet width direction W, the transverse alignment plates 52*a* and 52*b* are movable in a mutually approaching direction and a mutually separating direction. The transverse alignment plates 52*a* and 52*b* perform alignment of the sheets S in the sheet width direction W (i.e., transverse alignment).

The longitudinal alignment rollers 53 and the rear end stoppers 54 are provided to the end of the processing tray 51 on the upstream side. The longitudinal alignment rollers 53 cooperate with the discharge rollers 59*a*, which will be described later, to transport the sheets S placed on the processing tray 51 toward the rear end stoppers 54. The longitudinal alignment rollers 53 and the discharge rollers 59*a* cause the sheets S to abut on the rear end stoppers 54, to perform alignment of the sheets S in the sheet transport direction D (i.e., longitudinal alignment).

The stapler 55 is a processing device to perform the stapling processing. As shown in FIG. 3, the stapler 55 is provided to the end of the processing tray 51 on the upstream side. When the stapling mode is selected, the stapler 55 performs stapling (binding) processing on a bundle of the sheets S placed on the processing tray 51.

The ejectors 56 are provided to the end of the processing tray 51 on the upstream side. The ejectors 56 are movable toward the downstream side of the sheet transport direction D. The ejectors 56 pass the bundle of the sheets S, which have been subjected to the stapling processing or sorting processing, to the bundle claw 57.

The bundle claw 57 is mounted to the bundle claw belt 58.

The bundle claw belt 58 is stretched over a drive roller and a driven roller of the processing tray 51 (not shown). The bundle claw belt 58, the drive roller, and the driven roller are examples of the bundle claw drive mechanism 61 that drives the bundle claw 57. The bundle claw 57 moves in the sheet transport direction D and the opposite direction thereof in accordance with the movement of the bundle claw belt 58. The bundle claw 57 is an example of a "bundle discharge member". Together with the discharge rollers 59*a*, the bundle claw 57 discharges the bundle of the sheets S, which are passed from the ejectors 56, toward the movable tray 23*b* of the discharge tray device 23. For example, the tip end of the bundle claw 57 includes a projection (claw) 57*a* that protrudes in a forward direction that will be described later.

As shown in FIG. 3, the discharge rollers 59*a* and 59*b* include discharge drive rollers 59*a* and discharge pinch rollers 59*b*. The discharge drive rollers 59*a* are provided to the end of the processing tray 51 on the downstream side. The discharge drive rollers 59*a* come into contact with the sheets S from below, the sheets S being guided by the transport surface 51*a* of the processing tray 51. The discharge drive rollers 59*a* are examples of a "discharge member". The discharge drive rollers 59*a* discharge the sheets S, which are supported by the processing tray 51, from the processing tray 51 toward the movable tray 23*b* of the discharge tray device 23.

Meanwhile, the discharge pinch rollers 59*b* are provided above the discharge drive rollers 59*a*. The discharge pinch rollers 59*b* are driven rollers without a drive source. The discharge pinch rollers 59*b* are movable between a standby position located to be higher than the standby tray 41 and a turning position facing the discharge drive rollers 59*a*. The discharge pinch rollers 59*b* are driven by the pinch roller drive mechanism 62, to move between the standby position and the turning position. The discharge pinch rollers 59*b* move to the turning position, to pinch the sheets S together with the discharge drive rollers 59*a*. As a result, the rotation of the discharge drive rollers 59*a* is stably transmitted to the sheets S.

Next, a guide (slope guide) 71 provided to the processing tray 51 will be described. In the non-sorting mode, when the movable tray 23*b* is selected as a discharge destination of the sheets S, the post-processing apparatus 3 of this embodiment sends the sheets S, which have been supplied to the sheet supply port 35, from the second transport path 32 towards the discharge rollers 59*a* of the processing tray 51 without passing through the standby tray 41. The sheets S are then discharged to the movable tray 23*b* by the discharge rollers 59*a* of the processing tray 51.

It should be noted that the phrase of "without passing through the standby tray" means that the sheets S are not buffered in the standby tray 41, i.e., the sheets S are not retained in the standby tray. In other words, the phrase of "without passing through the standby tray" includes that the sheets S pass through between the first tray member 41*a* and the second tray member 41*b* in the standby tray 41 at the opened position at which the first tray member 41*a* and the second tray member 41*b* are separated from each other in the sheet width direction W. Further, the phrase of "without passing through the standby tray" may include a case where the sheets S come into contact with a part of the standby tray 41 depending on the shape of the standby tray 41.

Here, as shown in FIG. 3, there is a relatively large space between the outlet of the second transport path 32 and the discharge rollers 59*a* of the processing tray 51. Further, there is a relatively large drop between the outlet of the second transport path 32 and the processing tray 51. When the movable tray 23*b* is selected as a discharge destination of the sheets S in the non-sorting mode, the guide 71 of this embodiment stably guides the sheets S, which are sent from the second transport path 32, towards the discharge rollers 59*a* of the processing tray 51.

Figure 6A:
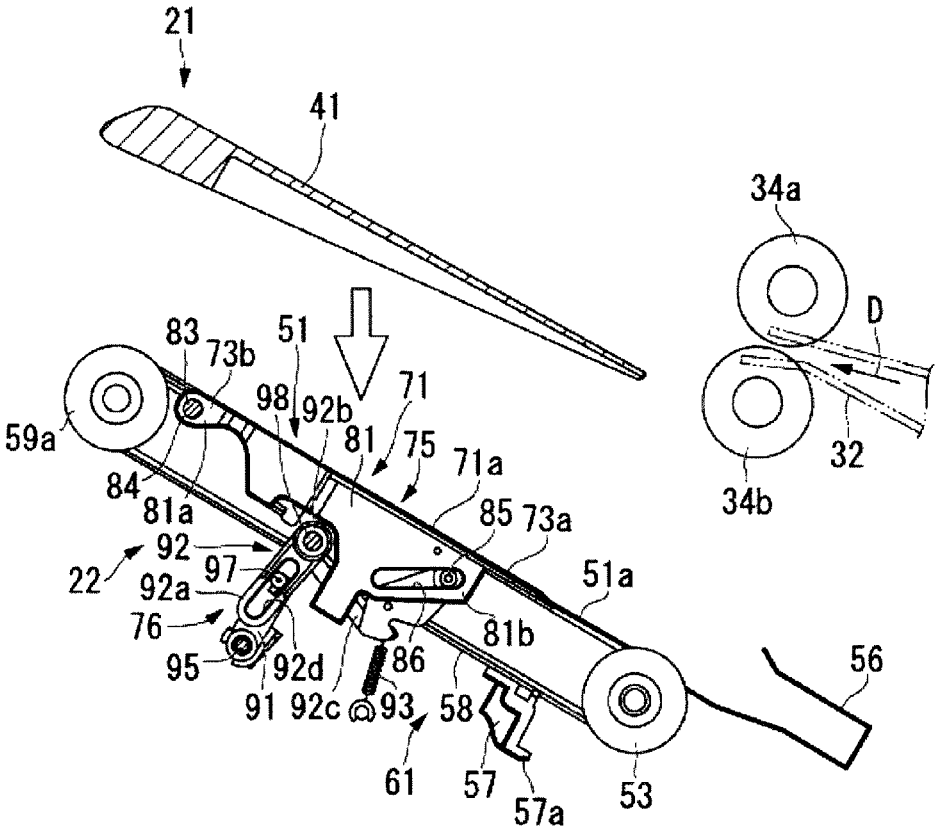
FIG. 6A is a cross-sectional view showing an operation example of a guide of the post-processing apparatus according to the embodiment.
Figure 6B:
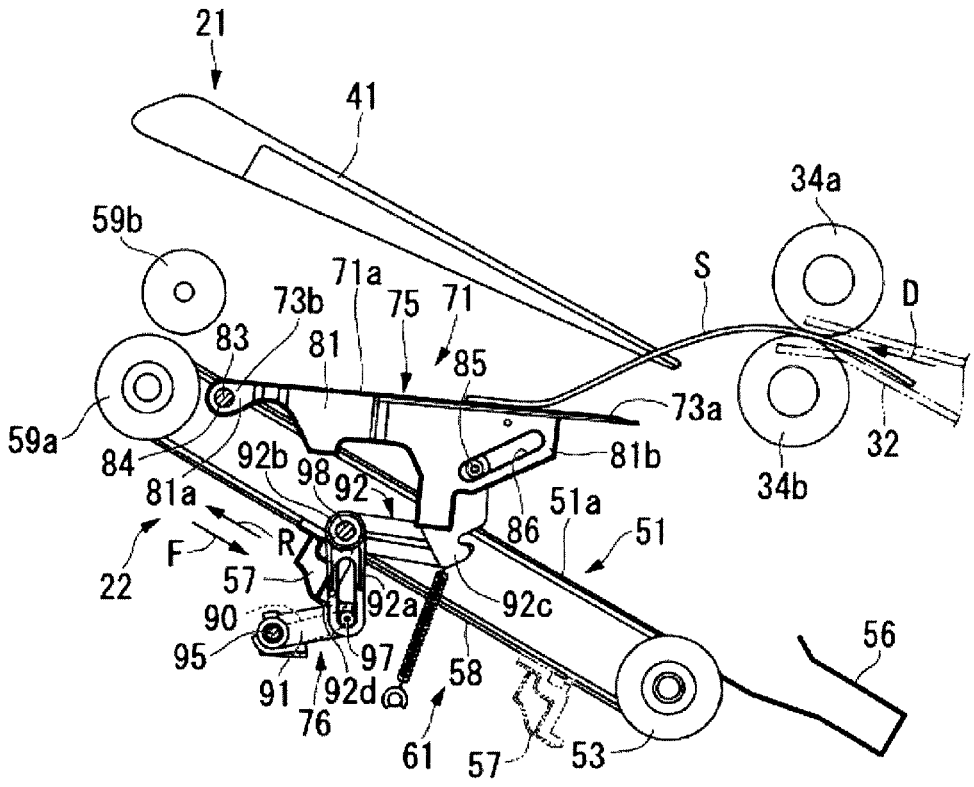
FIG. 6B is a cross-sectional view showing an operation example of the guide of the post-processing apparatus according to the embodiment.

Hereinafter, a configuration and an operation of the guide 71 will be described in detail. FIGS. 6A and 6B are cross-sectional views each showing an operation example of the guide 71. FIG. 6A shows the guide 71 located at a retracted position. FIG. 6B shows the guide 71 located at a protruding position. As shown in FIGS. 6A and 6B, the guide 71 is movable between the retracted position (standby position, first position) along the processing tray 51 and the protruding position (support position, second position) protruding from the processing tray 51.

Specifically, at the retracted position, the guide 71 is located along the transport surface 51*a* of the processing tray 51. As shown in FIG. 5, a concave portion (housing portion) 72 that houses the guide 71 is provided to the transport surface 51*a* of the processing tray 51. The guide 71 is housed in the concave portion 72, to thus be housed inside the processing tray 51. It should be noted that in FIG. 5, for convenience of description, the guide 71 is hatched with dots.

The guide 71 includes a support surface (upper surface) 71*a* that supports the sheets S. As shown in FIG. 5, at the retracted position, the support surface 71*a* of the guide 71 is located to be substantially flush with the transport surface 51*a* of the processing tray 51. In other words, at the retracted position, the guide 71 does not substantially protrude from the transport surface 51*a* of the processing tray 51. Thus, the guide 71 does not hinder the post-processing and the transport of the sheets S placed on the transport surface 51*a* of the processing tray 51. When the guide 71 is located at the retracted position, the sheets S placed on the transport surface 51*a* of the processing tray 51 are guided by the transport surface 51*a* of the processing tray 51, to thus be movable along the transport surface 51*a*.

Meanwhile, when the sheets S are sent from the second transport path 32 toward the discharge rollers 59*a* without passing through the standby tray 41, the guide 71 moves to the protruding position. As shown in FIG. 6B, at the protruding position, the guide 71 protrudes above the processing tray 51. In other words, the guide 71 protrudes from the processing tray 51 in a direction approaching the second transport path 32 and the outlet rollers 34*a* and 34*b*. As a result, the guide 71 supports the sheets S, which travel from the second transport path 32 toward the discharge rollers 59*a*, at a position higher than the processing tray 51.

Specifically, at the protruding position, the support surface 71*a* of the guide 71 is located at a height being between the processing tray 51 and the second transport path 32 and receives the sheets S sent from the second transport path 32. When the sheets S come into contact with the support surface 71*a* of the guide 71, a transport angle with respect to the processing tray 51 is changed. In other words, the transport angle of the sheets S with respect to the processing tray 51 becomes gentle. It should be noted that the phrase of "the transport angle of the sheets S with respect to the processing tray" means an angle defined between the transport surface 51*a* of the processing tray 51 and a transport direction (movement direction) of the sheets S.

More specifically, the guide 71 includes, as both ends thereof, an end 73*a* on the upstream side and an end 73*b* on the downstream side. As shown in FIG. 6B, at the protruding position, the end 73*a* of the guide 71 on the upstream side is located to be higher than the transport surface 51*a* of the processing tray 51. Meanwhile, the end 73*b* of the guide 71 on the downstream side is located to be lower than the transport surface 51*a* of the processing tray 51. As a result, the support surface 71*a* of the guide 71 is tilted with respect to the processing tray 51 so as to approach the transport surface 51*a* of the processing tray 51 toward the downstream side of the sheet transport direction D. As a result, the sheets S can be smoothly moved from the support surface 71*a* of the guide 71 to the transport surface 51*a* of the processing tray 51 at the end of the processing tray 51 on the downstream side.

Next, the position at which the guide 71 is disposed will be described. As shown in FIG. 5, the guide 71 is disposed between the paired transverse alignment plates 52*a* and 52*b* in the sheet width direction W. More specifically, a pair of guide main bodies 75 of the guide 71 is disposed at both sides of the bundle claw belt 58 in the sheet width direction W. The pair of guide main bodies 75 will be described later. Further, the guide main bodies 75 are disposed at substantially the same positions as the discharge rollers 59*a* in the sheet width direction W (i.e., positions aligned with the discharge rollers 59*a* in the sheet transport direction D). Thus, the sheets S are stably guided by the guide 71 to a position near the discharge rollers 59*a*.

Further, the guide 71 is disposed between the discharge rollers 59*a* and the longitudinal alignment rollers 53 in the sheet transport direction D. In other words, the guide 71 is provided to the processing tray 51 by using an area between the discharge rollers 59*a* and the longitudinal alignment rollers 53. Thus, if the guide 71 is provided, an increase in size of the processing tray 51 can be avoided.

More specifically, the guide main bodies 75 of the guide 71 are disposed on straight lines connecting the discharge rollers 59*a* and the longitudinal alignment rollers 53. Thus, when the guide 71 is located at the retracted position, the sheets S superimposed on the guide 71 are supported at both sides of the guide 71 (on the upstream side and the downstream side thereof) by the discharge rollers 59*a* and the longitudinal alignment rollers 53. Thus, the sheets S are smoothly transported along the transport surface 51*a* of the processing tray 51, also when there are differences in level or gaps between the guide 71 and the concave portion 72.

Figure 7:
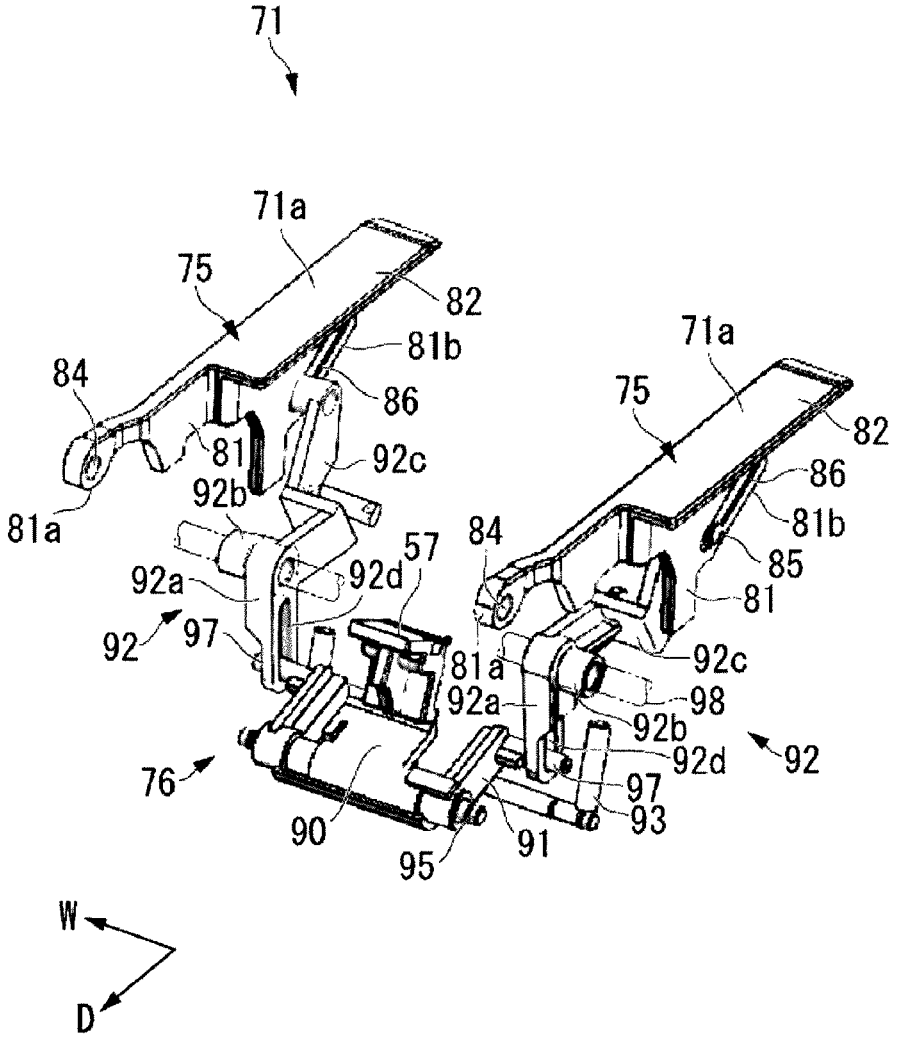
FIG. 7 is a perspective view showing a configuration example of the geode of the post-processing apparatus according to the embodiment.

Next, a configuration example of the guide 71 will be described. FIG. 7 is a perspective view showing a configuration example of the guide 71. As shown in FIG. 7, the guide 71 includes the pair of guide main bodies 75 and a linkage mechanism 76 that causes the pair of guide main bodies 75 to protrude from the processing tray 51. The linkage mechanism 76 of this embodiment is pressed by the bundle claw 57 of the processing tray 51, to cause the guide main bodies 75 to protrude from the processing tray 51.

Specifically, the paired guide main bodies 75 are provided separately from each other in the sheet width direction W. Each of the paired guide main bodies 75 includes a first portion 81 and a second portion 82. The first portion 81 is a standing portion that stands up in a vertical direction. As shown in FIGS. 6A and 6B, a hole 84 through which a turning shaft 83 passes is provided to an end 81*a* of the first portion 81 on the downstream side. It should be noted that the turning shaft 83 is a fixed shaft having a fixed position with respect to the processing tray 51. The turning shaft 83 is located to be lower than the transport surface 51*a* of the processing tray 51. The turning shaft 83 is provided along the sheet width direction W. The end 81*a* of the first portion 81 on the downstream side is supported so as to be rotatable by the turning shaft 83. As a result, the guide main bodies 75 are movable between the retracted position and the protruding position with the turning shaft 83 being as the center of rotation. Meanwhile, an end 81*b* of the first portion 81 on the upstream side is coupled to the linkage mechanism 76. Specifically, the end 81*b* of the first portion 81 on the upstream side is provided with a slot 86 through which a coupling pin 85 of the linkage mechanism 76 passes. The coupling pin 85 of the linkage mechanism 76 will be described later.

As shown in FIG. 7, the second portion 82 of each guide main body 75 is a support portion that supports the sheets S. The second portion 82 is folded from the upper end of the first portion 81 in the sheet width direction W to be formed in a plate shape. The second portion 82 includes an upper surface extending in the sheet width direction W. The upper surface of the second portion 82 forms the support surface 71*a* described above.

Meanwhile, the linkage mechanism 76 includes a panel 90, a first link 91, a second link 92, and a spring 93.

The panel 90 is a plate portion that receives external force acting on the linkage mechanism 76. The panel 90 is an example of a "receiving member". As shown in FIG. 6B, the panel 90 is provided below the processing tray 51. More specifically, the panel 90 is disposed at a position at which the bundle claw 57 passing under the processing tray 51 comes into contact with the panel 90.

Here, for convenience of description, a forward direction and a reverse direction are each defined as a moving direction of the bundle claw 57. The forward direction is a direction indicated by an arrow F in FIG. 6B. The forward direction is a direction in which the bundle claw 57 moves so as to discharge the bundle of the sheets S placed on the processing tray 51 toward the movable tray 23*b*. Meanwhile, the reverse direction is a direction indicated by an arrow R. The reverse direction is the opposite direction to the forward direction.

Figure 8A:
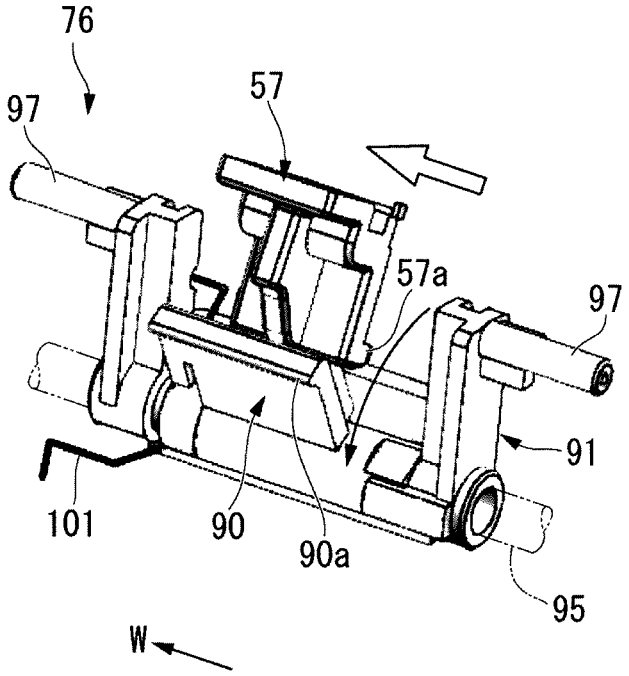
FIG. 8A is a perspective view showing a part of a linkage mechanism of the guide of the post-processing apparatus according to the embodiment.
Figure 8B:
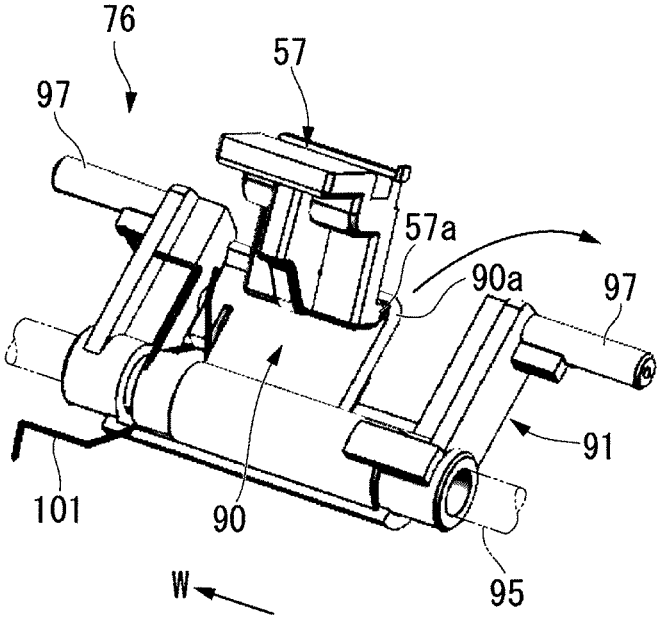
FIG. 8B is a perspective view showing a part of the linkage mechanism of the geode of the post-processing apparatus according to the embodiment.

FIGS. 8A and 8B are perspective views each showing the panel 90, the bundle claw 57, and the first link 91 in an enlarged manner. FIG. 8A shows a case where the bundle claw 57 comes into contact with the panel 90 from the reverse direction. FIG. 8B shows a case where the bundle claw 57 comes into contact with the panel 90 from the forward direction.

As shown in FIGS. 8A and 8B, the lower end of the panel 90 is supported to be turnable by a turning shaft 95. The turning shaft 95 is a fixed shaft having a fixed position with respect to the processing tray 51. The turning shaft 95 is provided along the sheet width direction W. Thus, when the bundle claw 57 comes into contact with the panel 90 in the forward direction or the reverse direction, the panel 90 can fall (turn) about the turning shaft 95.

Meanwhile, the upper end of the panel 90 includes a hook portion 90*a* with which the projection 57*a* of the bundle claw 57 engages. The hook portion 90*a* is a projection (claw) provided to the tip end of the panel 90. The projection 57*a* of the bundle claw 57 moving in the forward direction engages with the hook portion 90*a*. It should be noted that the operations of the panel 90 and the bundle claw 57 will be described later in detail.

As shown in FIGS. 8A and 8B, the first link 91 is provided behind the panel 90 in the forward direction of the bundle claw 57. The lower end of the first link 91 is supported to be turnable by the turning shaft 95 similarly to the panel 90. In other words, the first link 91 is capable of rocking about the turning shaft 95. When the panel 90 is pressed by the bundle claw 57 moving in the forward direction, the panel 90 comes into contact with the first link 91, and thus the first link 91 turns together with the panel 90. It should be noted that the first link 91 is formed into a shape to avoid a migration path of the bundle claw 57. Thus, the first link 91 does not come into contact with the bundle claw 57 moving in the forward direction and the reverse direction. Further, a coupling pin 97 is fixed to the upper end of the first link 91. The coupling pin 97 is a turning shaft that couples the first link 91 and the second link 92 to each other.

As shown in FIG. 7, the second link 92 includes a first portion 92*a*, a center portion 92*b*, and a second portion 92*c*. The first portion 92*a* is provided between the center portion 92*b* and the first link 91. The first portion 92*a* is provided with a slot 92*d* into which the coupling pin 97, which is fixed to the first link 91, is inserted. The coupling pin 97 is movable inside the slot 92*d*.

The center portion 92*b* is provided between the first portion 92*a* and the second portion 92*c*. The center portion 92*b* is attached to a turning shaft 98. The turning shaft 98 is a fixed shaft having a fixed position with respect to the processing tray 51. The turning shaft 98 is provided along the sheet width direction W. The second link 92 is capable of rocking about the turning shaft 98. Thus, when the first link 91 moves, the second link 92 rocks in accordance with the movement of the first link 91.

The second portion 92*c* is provided between the center portion 92*b* and the guide main body 75. The second portion 92*c* extends in a direction bent with respect to the first portion 92*a*. The coupling pin 85 is fixed to the second portion 92*c*. As described above, the coupling pin 85 is inserted into the slot 86 of the first portion 81 of the guide main body 75. Thus, when the second link 92 rocks, in accordance with the movement of the second link 92, the guide main body 75 moves between the retracted position and the protruding position.

As shown in FIGS. 6A and 6B, the spring 93 biases the second portion 92*c* of the second link 92 downward. In other words, the spring 93 biases the guide 71 toward the retracted position. Thus, in the state where the external force does not act, the guide 71 is retracted to the retracted position.

With the configuration described above, when the panel 90 is pressed by the bundle claw 57, the guide main bodies 75 protrude from the processing tray 51 via the first link 91 and the second link 92. In other words, the linkage mechanism 76 moves the guide 71 to the protruding position by the operation of the bundle claw 57. Further, when the bundle claw 57 separates from the panel 90, the guide 71 returns to the retracted position by a biasing force of the spring 93.

Next, an engagement operation of the panel 90 and the bundle claw 57 will be described.

As shown in FIG. 8A, when the bundle claw 57 moving in the reverse direction (first direction) comes into contact with the panel 90, the panel 90 allows passage of the bundle claw 57 without operating the linkage mechanism 76. Specifically, when the bundle claw 57 moving in the reverse direction comes into contact with the panel 90, the panel 90 turns in the reverse direction about the turning shaft 95, and thus allows passage of the bundle claw 57 in the reverse direction. Here, the first link 91 is located in the forward direction with respect to the panel 90. Thus, the panel 90 can fall (turn) so as to allow passage of the bundle claw 57 without pressing the first link 91. It should be noted that a spring 101 is provided between the panel 90 and the first link 91. The spring 101 biases the panel 90 toward the first link 91. After the bundle claw 57 passes, the panel 90 returns to a position aligned with the first link 91 by a biasing force of the spring 101.

Meanwhile, as shown in FIG. 8B, when the bundle claw 57 moving in the forward direction (second direction) comes into contact with the panel 90, the panel 90 engages with the bundle claw 57 and operates the linkage mechanism 76.

Specifically, when the bundle claw 57 moving in the forward direction comes into contact with the panel 90, the panel 90 turns in the forward direction about the turning shaft 95. In this embodiment, when the bundle claw 57 moving in the forward direction comes into contact with the panel 90, the projection 57*a* of the bundle claw 57 engages with the hook portion 90*a* of the panel 90. As a result, the bundle claw 57 is locked with respect to the panel 90. This prevents the bundle claw 57 from freely moving in the forward direction beyond the panel 90. The panel 90 is pressed by the bundle claw 57 in the forward direction, and thus turns in the forward direction. Here, the first link 91 is located in the forward direction with respect to the panel 90. Thus, when the panel 90 turns in the forward direction, the first link 91 is pressed by the panel 90. Thus, the linkage mechanism 76 operates, and the guide 71 protrudes from the processing tray 51.

Next, an operation example of the post-processing apparatus 3 will be described. In this embodiment, in the non-sorting mode, when the fixed tray 23*a* is selected as a discharge destination of the sheets S, the post-processing controller 24 controls a branch member (not shown), the discharge roller 33*a*, and the like such that the sheets S are discharged from the first transport path 31 to the fixed tray 23*a*. Further, when the sorting mode or stapling mode is selected as predetermined post-processing, the post-processing controller 24 controls the above-mentioned branch member, the standby device 21, the processing device 22, and the like such that the sheets S are transported from the second transport path 32 to the standby tray 41 and transported to the processing tray 51 after being temporarily kept waiting by the standby tray 41, and then discharged to the movable tray 23*b* after the post-processing is performed thereon.

Meanwhile, in the non-sorting mode, when the movable tray 23*b* is selected as a discharge destination of the sheets S, the post-processing controller 24 controls the post-processing apparatus 3 such that the sheets S are transported from the second transport path 32 toward the discharge rollers 59*a* of the processing device 22 and discharged to the movable tray 23*b* by the discharge rollers 59*a*. Specifically, the post-processing controller 24 controls the opening and closing drive mechanism 42 of the standby tray 41, to thus move the standby tray 41 to the opened position. In other words, the post-processing controller 24 separates the first tray member 41*a* and the second tray member 41*b* of the standby tray 41 from each other. As a result, the sheets S can move from the second transport path 32 toward the discharge rollers 59*a* without passing through the standby tray 41 (without being supported by the standby tray 41). Further, in the non-sorting mode, when the movable tray 23*b* is selected as a discharge destination of the sheets S, the post-processing controller 24 controls the bundle claw drive mechanism 61 to operate the bundle claw 57 as follows.

Figure 9A:
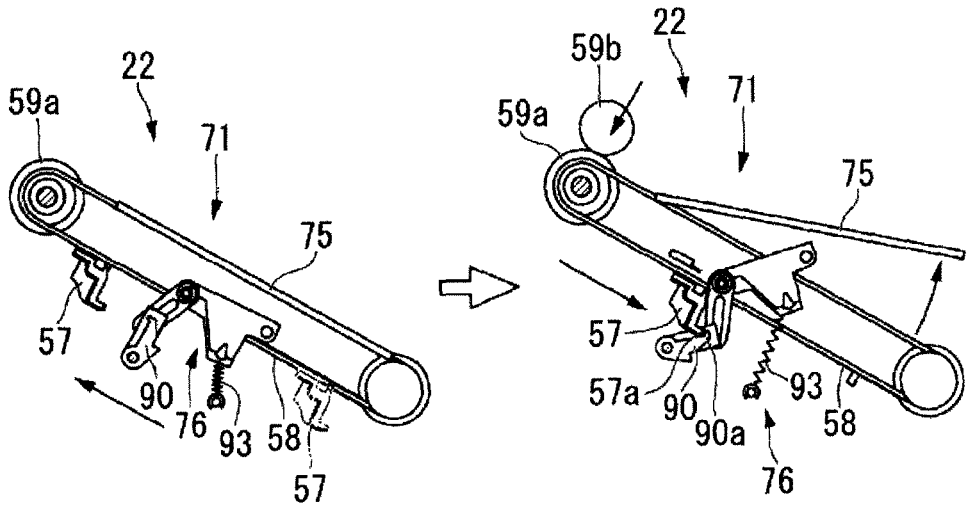
FIG. 9A is a cross-sectional view showing an operation example of a bundle claw of the post-processing apparatus according to the embodiment.
Figure 9B:
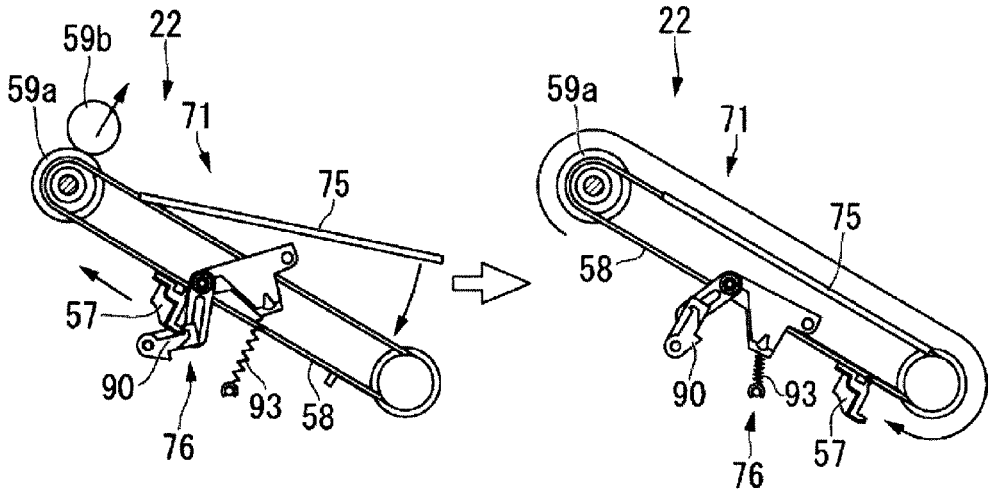
FIG. 9B is a cross-sectional view showing an operation example of the bundle claw of the post-processing apparatus according to the embodiment.

FIGS. 9A and 9B are cross-sectional views each showing an operation example of the bundle claw 57. It should be noted that FIG. 9A shows an operation to move the guide 71, which is located at the retracted position, to the protruding position. FIG. 9B shows an operation to return the guide 71, which protrudes to the protruding position, to the retracted position.

First, description will be given on a case where the guide 71 is moved to the protruding position. As shown in FIG. 9A, a home position of the bundle claw 57, which is indicated by a chain double-dashed line in FIG. 9A, is located at the end of the processing tray 51 on the upstream side, on the lower side of the bundle claw belt 58. The post-processing controller 24 controls the bundle claw drive mechanism 61 to move the bundle claw 57 in the reverse direction. As a result, the bundle claw 57 passes through the panel 90 by moving in the reverse direction.

After the bundle claw 57 moves in the reverse direction and pass through the panel 90, the post-processing controller 24 causes the bundle claw 57 to move in the forward direction and to come into contact with the panel 90. In this embodiment, when the bundle claw 57 moving in the forward direction comes into contact with the panel 90, the projection 57*a* of the bundle claw 57 engages with the hook portion 90*a* of the panel 90. As a result, the bundle claw 57 is locked with respect to the panel 90. The panel 90 is then pressed by the bundle claw 57 in the forward direction and thus turns in the forward direction. As a result, the linkage mechanism 76 operates, and the guide 71 protrudes from the processing tray 51.

Further, when the sheets S are sent from the second transport path 32 toward the discharge rollers 59*a*, the post-processing controller 24 controls the pinch roller drive mechanism 62 to cause the discharge pinch rollers 59*b* to descend to the turning position. As a result, the sheets S guided by the guide 71 are stably discharged toward the movable tray 23*b* by the discharge drive rollers 59*a* and the discharge pinch rollers 59*b*.

Next, description will be given on a case where the guide 71 is returned to the retracted position. As shown in FIG. 9B, the post-processing controller 24 controls the bundle claw drive mechanism 61 to move the bundle claw 57 in the reverse direction. When the bundle claw 57 separates from the panel 90, the guide 71 is returned to the retracted position by the biasing force of the spring 93. Further, the post-processing controller 24 controls the pinch roller drive mechanism 62 to raise the discharge pinch rollers 59*b* to the standby position.

Even after the bundle claw 57 separates from the panel 90, the post-processing controller 24 moves the bundle claw 57 in the reverse direction. As a result, the bundle claw 57 passes through the upper side of the processing tray 51, to move to the home position. As a result, the post-processing apparatus 3 enters a state capable of performing the post-processing.

According to the configuration described above, it is possible to provide a post-processing apparatus 3 capable of achieving improvement in stability of sheet transport. Here, as a comparative example, a post-processing apparatus including three lines of discharge paths will be considered. This post-processing apparatus includes a first path that discharges sheets to a fixed tray of a discharge tray device, a second path that discharges sheets from a standby tray to a movable tray of the discharge tray device, and a third path that discharges sheets from a processing tray to the movable tray. In such a post-processing apparatus, each path needs a device such as a motor and a dedicated component. This may increase manufacturing costs of the post-processing apparatus.

On the other hand, in the post-processing apparatus 3 of this embodiment, the sheet discharge paths are integrated into two lines. Specifically, as shown in FIG. 1, the post-processing apparatus 3 includes a first path that discharges the sheets S to the fixed tray 23*a* and a second path that discharges the sheets S from the processing tray 51 to the movable tray 23*b*. In other words, a discharge path used when the post-processing such as sorting processing or stapling processing is performed and a discharge path used when the sheets S are discharged to the movable tray 23*b* in the non-sorting mode are common. As a result, a dedicated component, a motor, and the like for discharging the sheets S from the standby tray 41 to the movable tray 23*b* can be omitted. Thus, it is possible to reduce costs of the post-processing apparatus 3 while maintaining a function similar to the comparative example.

According to the configuration described above, however, when the sheets S are discharged to the movable tray 23*b* in the non-sorting mode, the sheets S are directly sent from the second transport path 32 toward the discharge rollers 59*a* of the processing tray 51. Here, there is a relatively large space between the second transport path 32 and the discharge rollers 59*a*. Further, there is a relatively large drop between the second transport path 32 and the processing tray 51. Thus, for example, when sheets having curls (e.g., sheets having downward curls) are transported, such sheets S may curl up between the second transport path 32 and the discharge rollers 59*a* and cause a paper jam.

In this regard, the post-processing apparatus 3 of this embodiment includes the standby tray 41, the processing tray 51, the discharge rollers 59*a*, and the guide 71. The sheets S are sent from the second transport path 32 to the standby tray 41. The standby tray 41 supports the sheets S so as to temporarily keep the sheets S waiting. The processing tray 51 is provided below the standby tray 41. The processing tray 51 supports the sheets S moved from the standby tray 41 so as to perform predetermined post-processing on the sheets S. The discharge rollers 59*a* are provided to the processing tray 51 and discharge the sheets S from the processing tray 51 to the movable tray 23*b*. The guide 71 is provided to the processing tray 51. When the sheets S are sent from the second transport path 32 toward the discharge rollers 59*a* without passing through the standby tray 41, the guide 71 changes a transport angle of the sheets S with respect to the processing tray 51.

According to such a configuration, the transport angle of the sheets S (transport direction of the sheets S) sent from the second transport path 32 is changed by the guide 71, and this makes the sheets S difficult to curl up between the second transport path 32 and the discharge rollers 59*a*. This can suppress occurrence of a paper jam or the like. As a result, according to the configuration described above, it is possible to achieve improvement in stability of sheet transport.

In this embodiment, the guide 71 is movable between the first position (retracted position) along the processing tray 51 and the second position (protruding position) at which the guide 71 protrudes from the processing tray 51 to support the sheets S traveling from the second transport path 32 to the discharge rollers 59*a*. According to the configuration described above, it is possible to provide the guide 71 to the processing tray 51 without affecting the post-processing such as the sorting mode and the stapling mode. Further, according to the configuration described above, the guide 71 can be disposed between the paired transverse alignment plates 52*a* and 52*b*. According to such a configuration, it is possible to stably support the center portion of the sheets S by the guide 71. Thus, according to the configuration described above, it is possible to achieve further improvement in stability of sheet transport.

In this embodiment, the discharge rollers 59*a* are provided at the end of the processing tray 51 on the downstream side of the sheet transport direction D. At the second position, the guide 71 is tilted with respect to the processing tray 51 so as to approach the processing tray 51 toward the downstream side of the sheet transport direction D. According to such a configuration, the sheets S guided by the guide 71 can smoothly move from the guide 71 to the processing tray 51. As a result, it is possible to achieve further improvement in stability of sheet transport.

In this embodiment, at the second position, the end 73*b* of the guide 71 on the downstream side is located to be lower than the transport surface 51*a* of the processing tray 51. According to such a configuration, the guide 71 can reliably and stably guide the sheets S to the transport surface 51*a* of the processing tray 51. As a result, it is possible to achieve further improvement in stability of sheet transport.

In this embodiment, the post-processing apparatus 3 further includes the bundle claw 57. The bundle claw 57 discharges a sheet bundle (a bundle of sheets S) placed on the processing tray 51. The guide 71 includes the support surface 71*a* and the linkage mechanism 76. The support surface 71*a* supports the sheets S. The linkage mechanism 76 is pressed by the bundle claw 57, to thus cause the support surface 71*a* to protrude from the processing tray 51. According to such a configuration, it is possible to omit a dedicated drive mechanism (e.g., motor or solenoid) that causes the guide 71 to operate. This can achieve further reduction in costs and further downsizing of the post-processing apparatus 3.

Here, the bundle claw 57 may move in the forward direction from the home position, pass through the upper side of the processing tray 51, and then come around the lower side of the processing tray 51, to come into contact with the panel 90. However, in this case, depending on a state of the sheets S placed on the movable tray 23*b*, there is a possibility that when the bundle claw 57, which has passed through the upper side of the processing tray 51 in the forward direction, comes around the lower side of the processing tray 51, the bundle claw 57 comes into contact with the sheets S placed on the movable tray 23*b*. When the bundle claw 57 comes into contact with the sheets S placed on the movable tray 23*b*, the bundle claw 57 may be incapable of moving more. This may hinder the operation of the linkage mechanism 76 due to the bundle claw 57. Further, due to the contact between the bundle claw 57 and the sheets S, the bundle claw 57 may be broken.

In this regard, in this embodiment, when the bundle claw 57 moving in the reverse direction comes into contact with the panel 90, the panel 90 allows passage of the bundle claw 57. Additionally, when the bundle claw 57 moving in the forward direction comes into contact with the panel 90, the panel 90 is pressed by the bundle claw 57, to cause the linkage mechanism 76 to operate. According to such a configuration, after passing through the panel 90 by moving in the reverse direction, the bundle claw 57 can come into contact with the panel 90 by moving in the forward direction. In other words, according to the configuration described above, it is possible to eliminate a possibility that the bundle claw 57 comes into contact with the sheets S placed on the movable tray 23*b*. As a result, it is possible to reliably operate the linkage mechanism 76 by the bundle claw 57.

In this embodiment, when the guide 71 is returned from the protruding position to the retracted position, the post-processing apparatus 3 moves the bundle claw 57 in the reverse direction, so that the bundle claw 57 is separated from the panel 90. The post-processing apparatus 3 further moves the bundle claw 57 in the reverse direction, to return the bundle claw 57 to the home position. According to such a configuration, the bundle claw 57 moving in the forward direction does not need to pass through the panel 90. Thus, the panel 90 can have the hook portion 90*a* that locks the movement of the bundle claw 57 in the forward direction.

The panel 90 has the hook portion 90*a*, and thus the engagement operation between the panel 90 and the bundle claw 57 can be reliably performed. As a result, it is possible to achieve improvement in stability of operation of the post-processing apparatus 3.

Hereinabove, one embodiment has been described, but the configurations of embodiments are not limited to the above examples. For example, the operation of the linkage mechanism 76 may be performed by not the bundle claw 57 but a drive source such as a solenoid separately provided. In this case as well, since the solenoid is less expensive than a motor, it is possible to achieve reduction in costs of the post-processing apparatus 3, as compared with the case where the standby tray 41 is provided with a discharge roller. Further, the shape, size, position to be disposed, and the like of the guide 71 are not limited to the above examples and can be appropriately modified to be implemented. A "discharge member" that discharges the sheets S from the processing tray 51 is not limited to the discharge rollers 59*a* and may be a belt for discharging the sheets S, for example.

According to at least one embodiment described above, the post-processing apparatus includes the guide provided to the processing tray. When the sheets are sent to the discharge rollers from the transport path without passing through the standby tray, the guide changes a transport angle of the sheets with respect to the processing tray. As a result, it is possible to achieve improvement in stability of sheet transport.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

transport rollers that transport sheets supplied from outside of the sheet processing apparatus along a transport path;

a first tray including first and second tray members both configured to move toward each other to temporarily support the sheets transported from the transport path and move away from each other to cause the supported sheets to drop therebetween;

a second tray that is provided below the first tray and supports the sheets that are dropped from the first tray, on a receiving surface thereof;

a discharge member configured to discharge the sheets from the second tray;

a guide including a support surface for supporting the sheets and a linkage configured to move the support surface between a first position at which the support surface does not protrude from the receiving surface and a second position at which the support surface protrudes from the receiving surface so that the support surface supports the sheets traveling from the transport path toward the discharge member; and a bundle discharge member that discharges a bundle of the sheets supported by the second tray, wherein the linkage moves the support surface between the first and second positions in conjunction with a movement of the bundle discharge member to change a transport angle of the sheets transported from the transport path toward the discharge member without passing through the first tray.

2. The sheet processing apparatus according to claim 1, wherein when a receiving member included in the linkage is pressed by the bundle discharge member, the linkage moves the support surface to the second position from the first position.

3. The sheet processing apparatus according to claim 2, wherein the bundle discharge member is movable from a predetermined home position in a first direction and in a second direction opposite to the first direction, and discharges the bundle of the sheets by moving in the second direction from the home position, and the receiving member of the linkage comes into contact with the bundle discharge member moving in the first direction and the second direction.

4. The sheet processing apparatus according to claim 3, wherein the receiving member allows passage of the bundle discharge member when the bundle discharge member moving in the first direction comes into contact with the receiving member, and the receiving member is pressed by the bundle discharge member to cause the linkage to move the support surface to the second position, when the bundle discharge member moving in the second direction comes into contact with the receiving member.

5. The sheet processing apparatus according to claim 4, further comprising a controller, wherein the controller, in response to a selection signal to move the support surface from the first position to the second position, causes the bundle discharge member to temporarily move in the first direction from the predetermined home position to pass through the receiving member, move in the second direction, and then come into contact with the receiving member to press the receiving member.

6. The sheet processing apparatus according to claim 3, further comprising a controller, wherein the controller, in response to a selection signal to move the support surface from the second position to the first position, causes the bundle discharge member to move in the first direction from a position at which the bundle discharge member comes into contact with the receiving member, and press the receiving member, to separate from the receiving member and return to the home position.

7. The sheet processing apparatus according to claim 6, further comprising a spring that biases the support surface in a direction toward the first position, wherein when the bundle discharge member moves in the second direction to come into contact with the receiving member, the receiving member is pressed by the bundle discharge member against a biasing force of the spring, and the support surface moves to the second position, and when the bundle discharge member moves in the first direction to separate from the receiving member, the support surface moves to the first position by the biasing force of the spring.

8. The sheet processing apparatus according to claim 3, wherein the receiving member includes a hook portion that engages with the bundle discharge member moving in the second direction to lock a movement of the bundle discharge member in the second direction.

9. The sheet processing apparatus according to claim 1, wherein the support surface supports a center of the sheets in a width direction orthogonal to a transport direction of the sheets.

10. The sheet processing apparatus according to claim 9, wherein the second tray includes a pair of transverse alignment plates, the pair of transverse alignment plates being provided at both ends of the second tray in the width direction and aligning both ends of the sheets in the width direction of the sheets, and the support surface is provided between the pair of transverse alignment plates.

11. The sheet processing apparatus according to claim 1, further comprising:

a fixed discharge tray;

a movable discharge tray; and a processing device configured to perform predetermined post-processing on the sheets supported by the second tray, wherein the transport path includes a first transport path to transport the sheets onto the fixed discharge tray and a second transport path to transport the sheets onto the first tray from which the sheets are discharged onto the movable discharge tray.

12. The sheet processing apparatus according to claim 11, further comprising a controller, wherein when the fixed discharge tray is selected as a discharge destination of the sheets, the controller causes the transport rollers to transport the sheets to the fixed discharge tray through the first transport path, and when the movable discharge tray is selected as a discharge destination of the sheets and when the predetermined post-processing by the processing device is selected, the controller causes the transport rollers to transport the sheets to the first tray through the second transport path.

13. The sheet processing apparatus according to claim 1, wherein the discharge member is provided at an end of the second tray on a downstream side of a transport direction of the sheets, and when the support surface is at the second position, the support surface is tilted with respect to the receiving surface so that a downstream side end of the support surface in the transport direction is closer to the receiving surface than an upstream side end of the support surface.

14. The sheet processing apparatus according to claim 13, wherein an end of the support surface at the second position on the downstream side in the transport direction is lower than the receiving surface of the second tray.

15. The sheet processing apparatus according to claim 1, further comprising a controller, wherein the controller, in response to a selection signal to transport the sheets from the transport path to the discharge member without passing through the first tray, causes the first tray member and the second tray member to move away from each other.

16. The sheet processing apparatus according to claim 15, wherein the transport angle is an angle between a moving direction of the sheets when the sheets are dropped between the first tray member and the second tray member onto the second tray, and the receiving surface.

* * * * *